US010457478B2

(12) United States Patent
Flores

(10) Patent No.: US 10,457,478 B2
(45) Date of Patent: Oct. 29, 2019

(54) TRASH RECEPTACLE

(71) Applicant: Edward Flores, Wilmington, CA (US)

(72) Inventor: Edward Flores, Wilmington, CA (US)

( * ) Notice: Subject to any disclaimer, the term of this patent is extended or adjusted under 35 U.S.C. 154(b) by 0 days.

(21) Appl. No.: 16/115,501

(22) Filed: Aug. 28, 2018

(65) Prior Publication Data

US 2019/0062046 A1 Feb. 28, 2019

Related U.S. Application Data

(60) Provisional application No. 62/551,168, filed on Aug. 28, 2017.

(51) Int. Cl.

*B65F 1/06* (2006.01)
*B65F 1/16* (2006.01)
*B65F 1/00* (2006.01)

(52) U.S. Cl.

CPC ..... *B65F 1/062* (2013.01); *B65F 1/0006* (2013.01); *B65F 1/16* (2013.01); *B65F 2250/114* (2013.01)

(58) Field of Classification Search

CPC ..... B65D 83/0805; B65D 83/0835; B65D 83/0876; B65F 1/0006; B65F 1/04; B65F 1/06; B65F 1/062; B65F 1/065; B65F 1/067; B65F 1/068; B65F 1/16; B65F 2250/114

USPC ..... 220/495.07

See application file for complete search history.

(56) References Cited

U.S. PATENT DOCUMENTS 4,823,979 A * 4/1989 Clark, Jr. ..... B65F 1/062 220/495.07
8,317,055 B2 * 11/2012 Zawrotny ..... B65F 1/062 206/389
2001/0052522 A1 * 12/2001 Forest ..... B65D 25/14 220/495.07
2007/0215622 A1 * 9/2007 Perez ..... B65F 1/062 220/495.07
2008/0083757 A1 * 4/2008 Parker ..... B65F 1/062 220/495.07
2011/0220654 A1 * 9/2011 Gray ..... B65F 1/062 220/495.06
2015/0251849 A1 * 9/2015 Yang ..... B65F 1/16 220/661
2016/0137411 A1 * 5/2016 Rogers ..... B65F 1/062 220/495.07
2018/0222672 A1 * 8/2018 Leon ..... B65F 1/14
2019/0062046 A1 * 2/2019 Flores ..... B65F 1/062

* cited by examiner

*Primary Examiner* — Joshua E Rodden

(57) ABSTRACT

An improved trash receptacle includes an integrated, door covered bag dispenser on the back side of the receptacle structured and arranged to provide adequate housing for a roll of trash bags, along with a slot through which to feed the bags, to facilitate the process of changing out a trash bag by offering an easily accessible and convenient storage space for replacement garbage bags.

10 Claims, 4 Drawing Sheets

TRASH RECEPTACLE

CROSS-REFERENCE TO RELATED APPLICATION

The present application is related to and claims priority from prior provisional application Ser. No. 62/551,168, filed Aug. 28, 2017 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of trash receptacles and more specifically relates to an improved trash receptacle comprising an integrated, door covered bag dispenser on the back side of the receptacle structured and arranged to provide adequate housing for a roll of trash bags, along with a slot through which to feed the bags, to facilitate the process of changing out a trash bag by offering an easily accessible and convenient storage space for replacement garbage bags.

2. Description of the Related Art

A waste container is a container for temporarily storing waste and is usually made out of metal or plastic. Some common terms are dustbin, garbage can, and trash can. "Garbage" may refer to food waste specifically (when distinguished from "trash") or to municipal solid waste in general.

Various attempts have been made to solve problems found in trash receptacles art. Among these are found in: U.S. Pat. No. 8,317,055 to Leanne Zawrotny; U.S. Pat. No. 5,704,511 to Kelly Kellams; and U.S. Pat. No. 7,168,591 to Christopher J. Miller. This prior art is representative of trash bag dispensing trash receptacles. None of the above inventions and patents, taken either singly or in combination, is seen to describe the invention as claimed.

Ideally, an improved trash receptacle should be user-friendly and safe in-use and yet would operate reliably and be manufactured at a modest expense. Thus, a need exists for an improved trash receptacle comprising an integrated, door covered bag dispenser on the back side of the receptacle structured and arranged to provide adequate housing for a roll of trash bags, along with a slot through which to feed the bags, to facilitate the process of changing out a trash bag by offering an easily accessible and convenient storage space for replacement garbage bags and to avoid the above-mentioned problems.

BRIEF SUMMARY OF THE INVENTION

In view of the foregoing disadvantages inherent in the known of trash receptacles device art, the present invention provides a novel Improved Trash Receptacle. The general purpose of the present invention, which will be described subsequently in greater detail is to provide an improved trash receptacle comprising an integrated, door covered bag dispenser on the back side of the receptacle structured and arranged to provide adequate housing for a roll of trash bags, along with a slot through which to feed the bags, to facilitate the process of changing out a trash bag by offering an easily accessible and convenient storage space for replacement garbage bags.

An improved trash receptacle comprising: a main body; a roll of garbage bags; a back panel door; and a lid. The main body includes: a front panel; a back panel including a recessed portion defining a rectangular volume, and an elongated slot adapted to allow garbage bags to transfer therethrough; two side panels; and a bottom panel. Wherein the two side panels are spaced from one another and connected between side edges of the front and back panels. Wherein the bottom panel is connected between bottom edges of the front panel, the back panel, and the two side panels. Wherein the front panel, the back panel, the two side panels, and the bottom panel form an interior volume.

Wherein the roll of garbage bags is movably connected between opposite interior walls of the recessed portion of the back panel and adapted to allow one bag at a time to be removed therefrom. Wherein one bag of the roll of garbage bags is placed within the elongated slot, such that it can be grabbed and pulled through the elongated slot and used to removably line the interior volume of the main body. Wherein when the one bag of the roll of garbage bags is grabbed and pulled through the elongated slot for use it pulls the next bag of the roll of garbage bags into the elongated slot for easy access upon the need to replace said bag being used to line said interior volume of said main body.

Wherein the back panel door is pivotally connected to the back panel and adapted to removably cover the recessed portion and enclose the roll of garbage bags therein. Wherein the lid is adapted to removably connect with top edges of the front panel, the back panel, and the two side panels to thereby removably enclosed the interior volume.

The present invention holds significant improvements and serves as an Improved Trash Receptacle. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, an Improved Trash Receptacle, constructed and operative according to the teachings of the present invention.

The various embodiments of the present invention will hereinafter be described in conjunction with the appended drawings, wherein like designations denote like elements.

DETAILED DESCRIPTION

Figure 1:
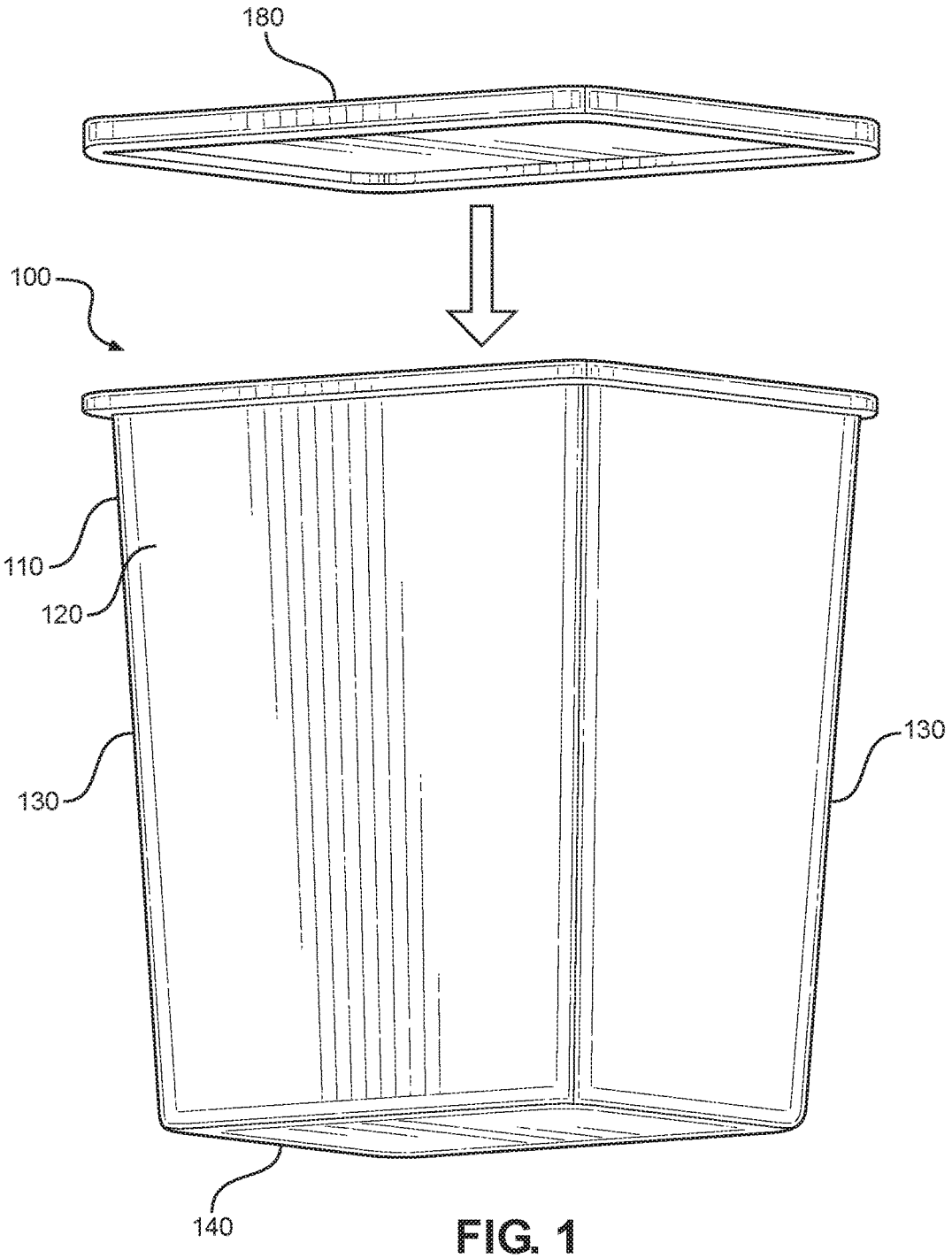
FIG. 1 shows a front perspective view illustrating an Improved Trash Receptacle according to an embodiment of the present invention.

As discussed above, embodiments of the present invention relate to trash receptacle device and more particularly to an improved trash receptacle comprising an integrated, door covered bag dispenser on the back side of the receptacle structured and arranged to provide adequate housing for a roll of trash bags, along with a slot through which to feed the bags, to facilitate the process of changing out a trash bag by offering an easily accessible and convenient storage space for replacement garbage bags.

Generally speaking, the Improved Trash Receptacle comprises a specially designed trash receptacle to enable consumers to store clean garbage bags directly within their garbage can, The Improved Trash Receptacle would be manufactured in a variety of sizes appropriate for indoor and outdoor use and could be constructed of heavy duty plastic material. As an example, a standard kitchen model with a forty (40) gallon capacity could measure approximately three feet (3') in height and two and one-half feet (2½') in width. (Measurements may vary).

Generally rectangular in shape, The Improved Trash Receptacle could feature an integrated or removable lid for the purpose of containing odors and preventing spillage. The most notable aspect of this product, however, is that this cleverly designed trash receptacle features a built-in bag dispenser. The dispenser compartment is located at the back of the can in the form of a recessed niche, which can be easily accessed via a hinge-mounted door. Extending upward approximately ¾ of the height of the can, this compartment would boast a clever rolling bar at its bottom, on which a coil of up to two hundred (200) clean, fresh plastic bags would be placed. At the top of the niche would be a slot through which the garbage bags would be fed and dispensed. With the door closed, the user could grab the garbage bag, pull upward and separate the bag from the roll. The next bag in line would simultaneously be fed through the slot, for the next use. The Improved Trash Receptacle could be produced in a variety of attractive colors, as well as in standard white.

The Improved Trash Receptacle would offer consumers an easy and convenient means of storing garbage bags. First as a space saver, use of The Improved Trash Receptacle would provide a practical alternative to storing garbage bags in overcrowded cupboards, cabinets and closets. Another advantage is that this product could store hundreds of clean garbage bags in an efficient manner, and one which is close at hand. Providing ample room within the dispenser compartment for an entire roll of garbage bags, The Improved Trash Receptacle would ensure that clean garbage bags were always at one's fingertips. Easily accessed, this unique dispenser would also enable consumers to quickly and conveniently replace used bags with a fresh, clean garbage bag in a manner of seconds. Manufactured in a variety of sizes, colors and styles, The Improved Trash Receptacle would be well suited for use in bathrooms, kitchens, bedrooms and garages. Simple to use, this functional product could prove an invaluable accessory in any home or business establishment.

Referring to the drawings by numerals of reference there is shown in FIGS. 1-4, perspective views illustrating improved trash receptacle 100 according to an embodiment of the present invention.

Figure 2:
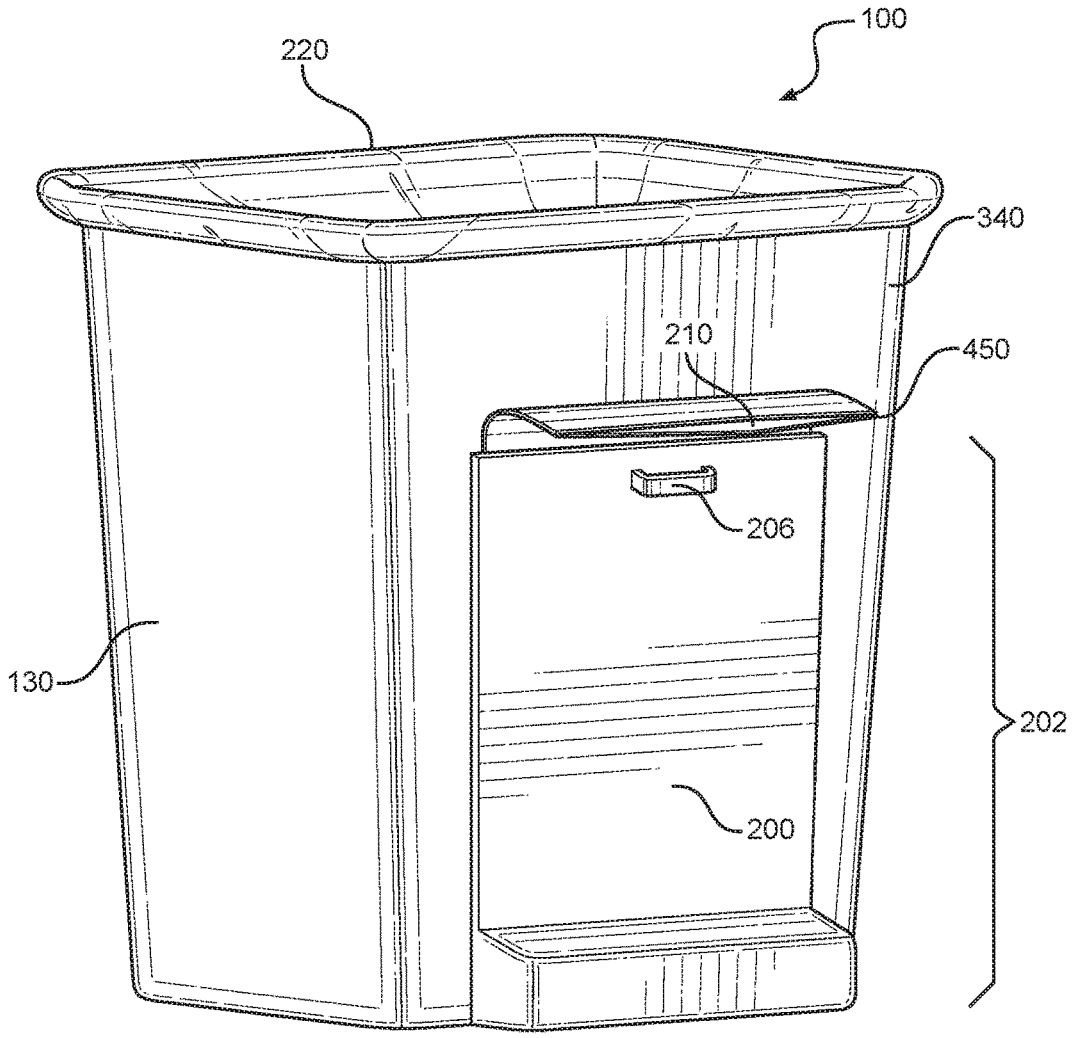
FIG. 2 is a back perspective view illustrating another view of the Improved Trash Receptacle according to an embodiment of the present invention of FIG. 1.
Figure 3:
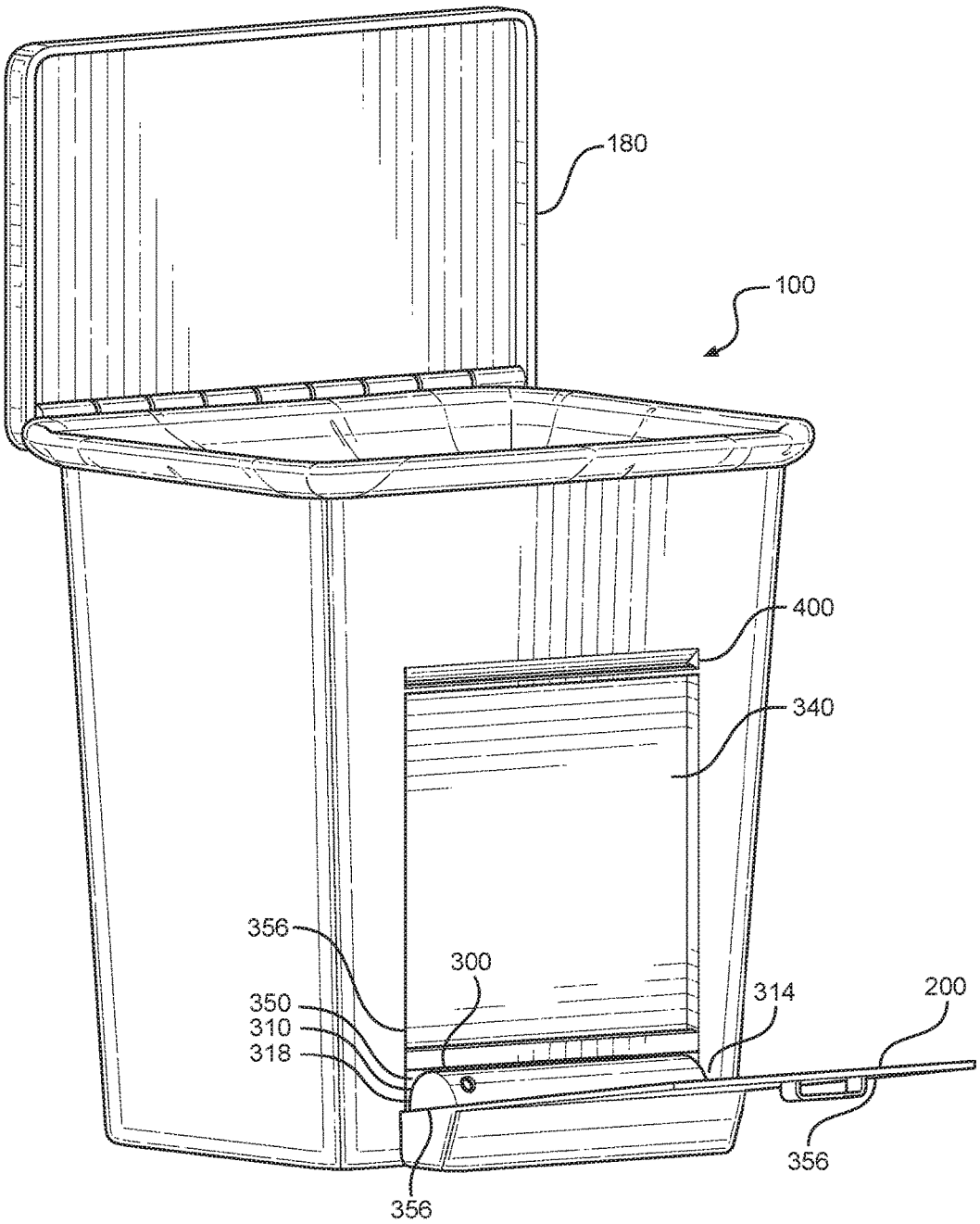
FIG. 3 is a back perspective view illustrating yet another view of the Improved Trash Receptacle according to an embodiment of the present invention of FIG. 1.
Figure 4:
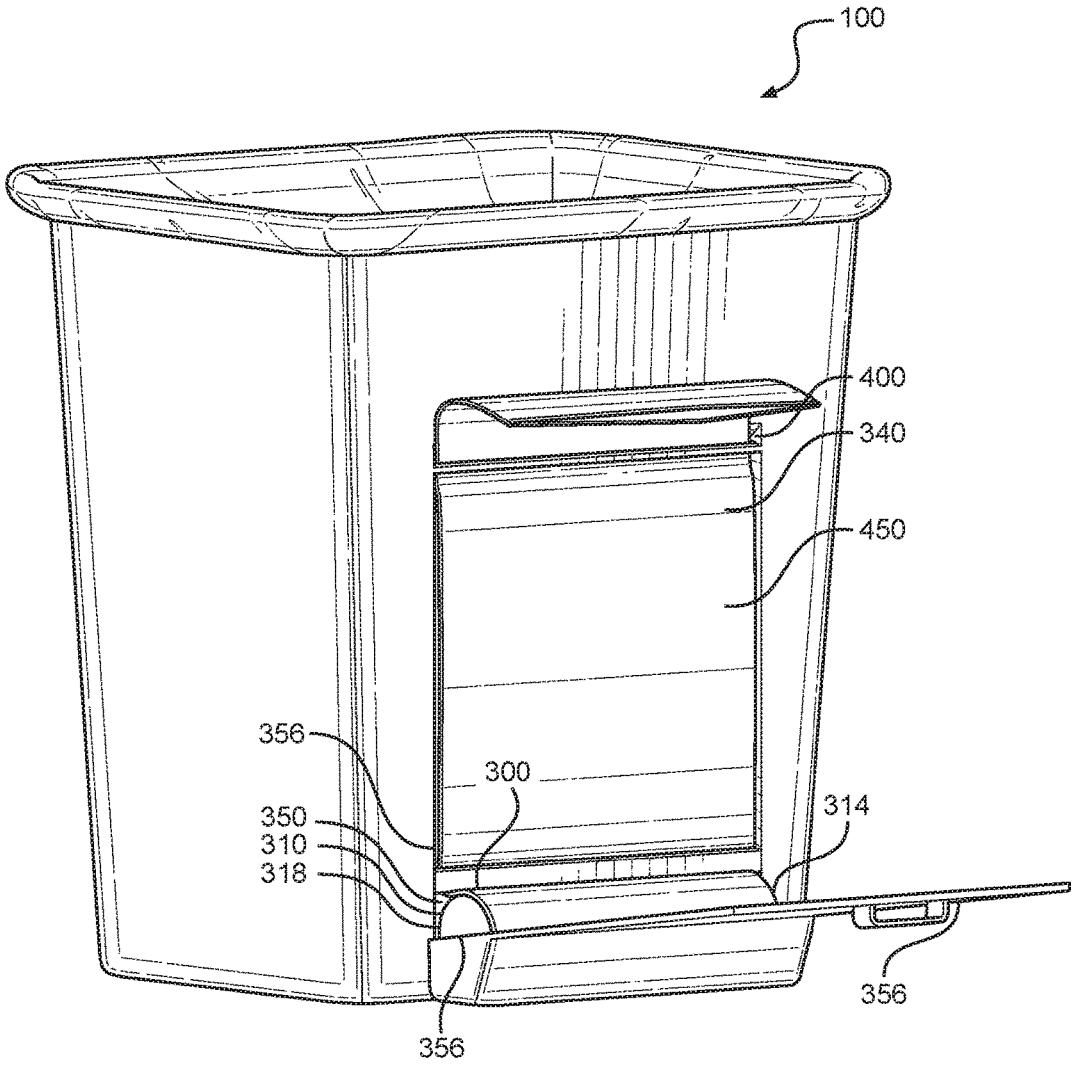
FIG. 4 is a back perspective view illustrating yet another view of the Improved Trash Receptacle according to an embodiment of the present invention of FIG. 1.

Improved trash receptacle 100 comprising: main body 110; roll of garbage bags 300; back panel door 200 and lid 180. Main body 110 includes: front panel 120; back panel 340 including recessed portion 350 defining rectangular volume, and elongated slot 400 adapted to allow garbage bags 300 to transfer therethrough; two side panels 130; and bottom panel 140. Wherein two side panels 130 are spaced from one another and connected between side edges of the front panel 120 and back panel 340. Wherein bottom panel 140 is connected between bottom edges of the front panel 120, back panel 340, and the two side panels 130. Wherein front panel 120, back panel 340, two side panels 130, and bottom panel 140 form interior volume 220. Wherein interior volume 220 of main body 110 is formed as a rectangular volume. Wherein interior volume 220 of main body 110 is formed having a forty-gallon capacity. Wherein main body 110 is formed having a height of three feet and a width of two and one-half feet. Wherein main body 110, back panel door 200, and lid 180 are formed from a plastic material.

Wherein lid 180 is adapted to removably connect with top edges of front panel 120, back panel 340, and two side panels 130 to thereby removably enclosed interior volume 220 as shown in FIG. 1. Wherein lid 180 is pivotally connected to a top edge of one of front panel 120, back panel 340, and two side panels 130 as shown in FIG. 4.

Wherein back panel door 200 is pivotally connected to back panel 340 and adapted to removably cover recessed portion 350 and enclose roll of garbage bags 300 therein. Wherein back panel door 200 includes handle 206 on an outer surface thereof adapted to pivotally manipulate back panel door 200 between open position 302 as shown in FIG. 3 and closed position 202 as shown in FIG. 2. Wherein back panel door 200 includes semi-cylindrical recess 210 therein adapted to allow a portion of roll of garbage bags 300 to reside therein when back panel door 200 is in closed position 202 as shown in FIG. 2.

Wherein roll of garbage bags 300 is movably connected between opposite interior walls of the recessed portion 350 of back panel 340 and adapted to allow one bag 450 at a time to be removed therefrom. Wherein one bag 450 of roll of garbage bags 300 is placed within elongated slot 400, such that it can be grabbed and pulled through elongated slot 400 and used to removably line the interior volume 220 of main body 110 as shown in FIG. 2. Wherein when one bag 450 of roll of garbage bags 300 is grabbed and pulled through elongated slot 400 for use it pulls the next bag of roll of garbage bags 300 into elongated slot 400 for easy access upon the need to replace bag 450 being used to line interior volume 220 of main body 110.

Wherein roll of garbage bags 300 comprises garbage bags 450. Wherein roll of garbage bags 300 includes axle member 310 having opposite ends 314; and wherein opposite interior walls 356 of recessed portion 350 of back panel 340 includes two axle end holding portions 318 adapted to releasably hold respective said opposite ends 314 of axle member 310 therein, such that roll of garbage bags 300 can spin within recessed portion 350, and such that roll of garbage bags 300 be removably replaced by another roll of garbage bags 300 when desired.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. An improved trash receptacle comprising:

a main body including:

a front panel;

a back panel including:

a recessed portion defining a rectangular volume; and an elongated slot adapted to allow garbage bags to transfer therethrough, externally to said main body;

two side panels;

wherein said two side panels are spaced from one another and connected between side edges of said front and back panels; and a bottom panel;

wherein said bottom panel is connected between bottom edges of said front panel, said back panel, and said two side panels;

wherein said front panel, said back panel, said two side panels, and said bottom panel form an interior volume;

a roll of garbage bags;

wherein said roll of garbage bags is movably connected between opposite interior walls of said recessed portion of said back panel and adapted to allow one bag of said roll of garbage bags at a time to be removed therefrom; and wherein said one bag of said roll of garbage bags is placed within said elongated slot, such that it can be grabbed and pulled through said elongated slot and used to removably line said interior volume of said main body; and wherein when said one bag of said roll of garbage bags is grabbed and pulled through said elongated slot for use it pulls a next bag of said roll of garbage bags into said elongated slot for easy access upon the need to replace said one bag being used to line said interior volume of said main body;

a back panel door;

wherein said back panel door is pivotally connected to said back panel and adapted to removably cover said recessed portion and enclose said roll of garbage bags therein; and a lid;

wherein said lid is adapted to removably connect with top edges of said front panel, said back panel, and said two side panels to thereby removably enclosed said interior volume.

2. The improved trash receptacle of claim 1, wherein said lid is pivotally connected to said top edge of one of said front panel, said back panel, and said two side panels.

3. The improved trash receptacle of claim 1, wherein said roll of garbage bags comprises 200 garbage bags.

4. The improved trash receptacle of claim 1, wherein said interior volume of said main body is formed as a rectangular volume.

5. The improved trash receptacle of claim 1, wherein said roll of garbage bags includes an axle member having opposite ends; and wherein said opposite interior walls of said recessed portion of said back panel includes two axle end holding portions adapted to releasably hold respective said opposite ends of said axle member therein, such that said roll of garbage bags can spin within said recessed portion, and such that said roll of garbage bags be removably replaced by another roll of garbage bags when desired.

6. The improved trash receptacle of claim 1, wherein said back panel door includes a handle on an outer surface thereof adapted to pivotally manipulate said back panel door between opened and closed positions.

7. The improved trash receptacle of claim 6, wherein said back panel door includes a semi-cylindrical recess therein adapted to allow a portion of said roll of garbage bags to reside therein when said back panel door is in said closed position.

8. The improved trash receptacle of claim 1, wherein said main body is formed having a height of three feet and a width of two and one-half feet.

9. The improved trash receptacle of claim 1, wherein said interior volume of said main body is formed having a forty gallon capacity.

10. The improved trash receptacle of claim 1, wherein said main body, said back panel door, and said lid are formed from a plastic material.

* * * * *